United States Patent [19]

Riggs

[11] 4,223,459

[45] Sep. 23, 1980

[54] ATHLETIC SHOE FOR RACING AND TRAINING

[76] Inventor: Donnie E. Riggs, 1606 Monteval Ct., San Jose, Calif. 95120

[21] Appl. No.: 929,647

[22] Filed: Jul. 31, 1978

[51] Int. Cl.[2] ..... A43B 5/00; A43B 23/28

[52] U.S. Cl. ..... 36/114; 36/59 C

[58] Field of Search ..... 36/114, 59 R, 59 C, 36/67 R, 67 A, 67 B, 67 C, 67 D, 126, 127, 128, 129, 134, 30 R

[56] References Cited

U.S. PATENT DOCUMENTS

| | | | |
|---|---|---|---|
| 3,018,571 | 1/1962 | Doherty | 36/59 C |
| 3,818,617 | 6/1974 | Dassler et al. | 36/32 R |
| 4,011,666 | 3/1977 | Lehmann | 36/59 C |
| 4,060,917 | 12/1977 | Canale | 36/32 R |
| 4,085,527 | 4/1978 | Riggs | 36/114 |

*Primary Examiner*—Patrick D. Lawson
*Attorney, Agent, or Firm*—Gerald L. Moore

[57] ABSTRACT

An athletic shoe particularly adapted for use in racing and training, having a tilted cleat configuration on the sole for contacting the running surface in a manner to provide good traction while effectively cushioning the foot and leg of the wearer when the foot strikes the ground.

3 Claims, 4 Drawing Figures

ATHLETIC SHOE FOR RACING AND TRAINING

BACKGROUND OF THE INVENTION

With the advent of artificial surfaces for competitive running which surfaces usually are harder than previously used natural surfaces, it has been found necessary to cushion the runner's foot as much as possible to lessen the shock resulting as the foot is set down. One example of such cushioning is shown in the U.S. Pat. No. 4,085,527, entitled: ATHLETIC SHOE and issud on Apr. 25, 1978, with the same inventor as this application. Such cushioning is provided in the shoe of that patent by resilient cleats positioned on the bottom of the sole and extending vertically downward toward the running surface. These cleats provide both traction and cushioning as the foot contacts the running surface.

It is the purpose of this invention to provide an improved cleat design for athletic shoes which enhances both the traction and the cushioning effect rendered to the runner.

SUMMARY OF THE INVENTION

An athletic shoe having an upper portion for receiving the foot, with a sole attached presenting a bottom planar surface for contacting the running surface. Fixed to this planar surface are a plurality of resilient cleats extending generally downward to contact the running surface. These cleats are fixed at angles other than 90° to the planar surface so as to facilitate compression and bending thereof for cushioning the foot while increasing the ability of the cleats to withstand the forces exerted between the shoe and the running surface during periods of acceleration, stopping and turning.

DESCRIPTION OF THE INVENTION

DESCRIPTION OF THE INVENTION

Figure 1:
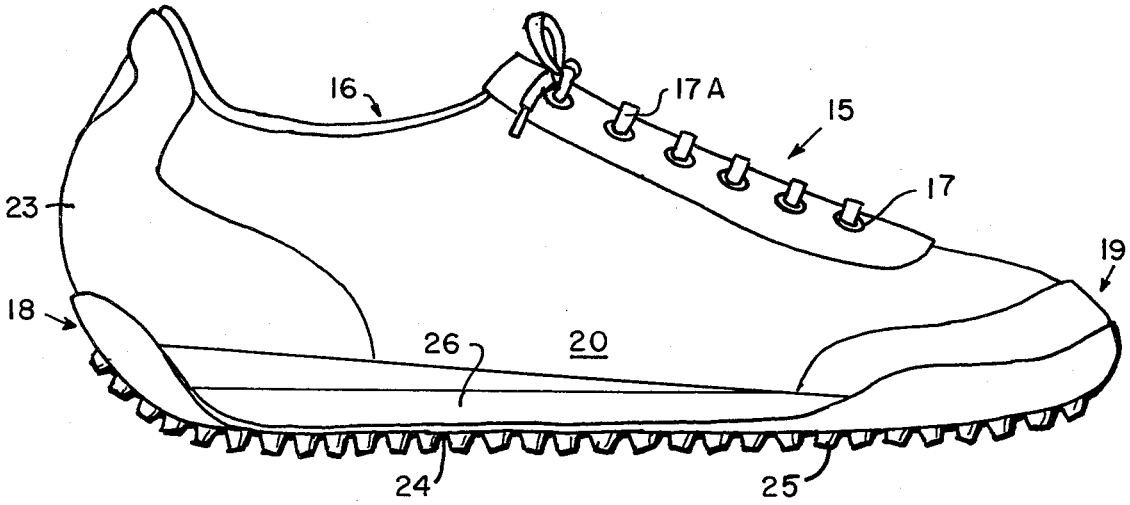
FIG. 1 is a side plan view of an athletic shoe incorporating one embodiment of the subject invention.
Figure 2:
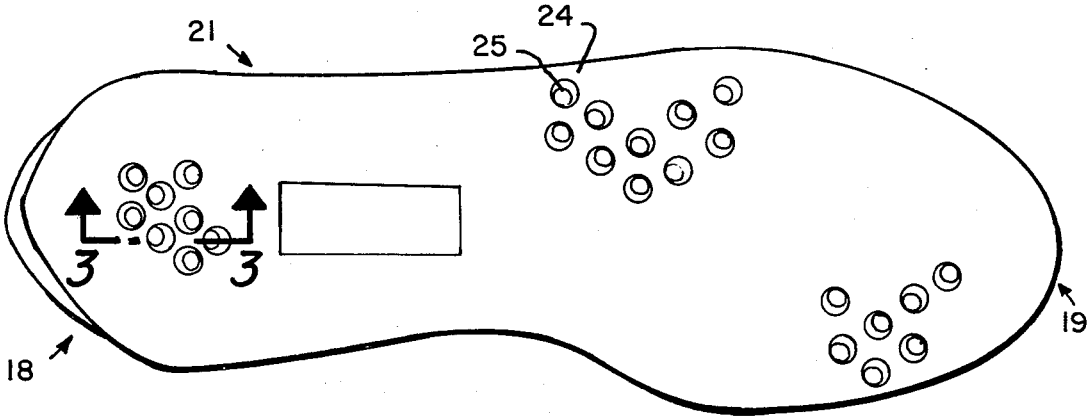
FIG. 2 is a bottom view of the shoe of FIG. 1.

As shown primarily in FIGS. 1 and 2, the invention is embodied in an athletic shoe 15 including an upper portion 16 formed to enclose the foot of the wearer. The shoe upper portion is of a normal type usually being formed of leather or a synthetic material, or a combination thereof, and being laced by shoestrings 17A passed through the eyelets 17. The shoe upper portion includes a heel portion 18, a toe portion 19, and a center or shank portion 20 which supports the arch and ball areas of the foot. The heel portion also includes a heel counter 23 formed to enclose and support the heel. The upper portion supports a sole 21 which forms the wear surface for contacting the running surface. The sole is fixed to the upper portion in a suitable manner, such as by gluing and/or sewing.

Fixed to the bottom planar surface 24 of the sole 21 are a plurality of cleats 25 positioned in a manner to extend generally downward to contact the running surface when the shoe is worn. These cleats preferably are molded integrally with the sole or a portion of the sole and are made of rubber or a similar resilient material to provide both traction and cushioning for the foot.

Cushioning is also partially provided by a midsole 26 sandwiched between the cleats and the upper portion, which midsole is made of a resilient material such as rubber or the like. In the normal functioning of such shoes, this midsole tends to give or compress as pressure is exerted thereon as the cleats contact the ground. With the cleats being positioned primarily to extend normal to the bottom planar surface 24 of the sole they also tend to compress as the foot is set on the running surface for cushioning of the foot.

However, the providing of cushioning for the foot can decrease the stability of the shoe with the running surface. With the cleats extending normal to the sole bottom, they are placed both in direct compression and in shear during a turning or accelerating maneuver by the wearer. Thus the cleats tend to bend if they are sufficiently long to provide a large amount of cushioning whereas the shorter cleats provide less cushioning. The direction of such bending is unpredictable and depends on the direction of the shear forces exerted between the foot and the ground. However such a bending or rolling action by the cleats does tend to lessen the stability of the foot and also may tend to lessen the traction with the running surface since the flat bottom surface of the cleat may roll over sidewise under excessive bending.

Some attempts have been made to use shorter cleats and compensate for any loss in cushioning by increasing the thickness of the midsole. However the midsole, in extending across the total bottom surface of the shoe, represents a substantial portion of the shoe weight. Therefore any increase in thickness of this midsole can make the shoe considerably heavier, a factor of special significance in athletic racing shoes. The midsole must be of sufficient thickness to assure that the compression of it does not extend through sufficiently to bulge an exert a pressure on specific areas of the wearer's foot.

Figure 3:
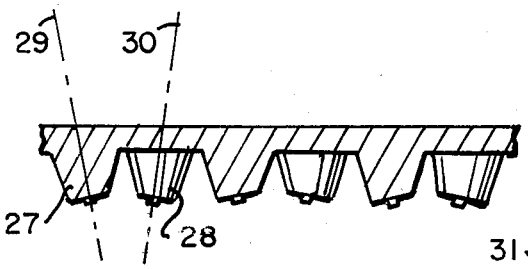
FIG. 3 is an enlarged cross-sectional view of a portion of the sole and cleats of the shoe in FIG. 2 taken along the line 3—3 thereof.
Figure 4:
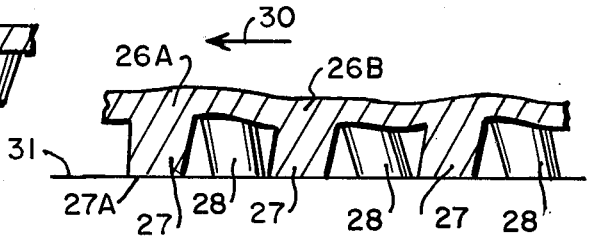
FIG. 4 is the view of FIG. 3 showing the flexing of the cleats as the shoe contacts the running surface.

In accordance with one feature of the invention, the cleats are fixed to the bottom planar surface 24 of the midsole so as to extend downward at an angle other than normal to the midsole surface. As shown primarily in FIGS. 2 and 3, the cleats 27 and 28 extend with the respective axes 29 and 30 at an angle other than normal to the plane of the midsole surface. In the invention, the angle between each axis and this sole surface can range between 15 degrees and 89 degrees. The purpose for positioning these cleats at this attitude is demonstrated primarily in FIG. 4 showing these same cleats as they would appear under the force of being pressed against the running surface 31 while shear forces are being encountered as can be caused by turning, etc. As can be seen, the cleats now have assumed a skewed attitude in which they tend to bend or distort sideways in the direction originally positioned. At the same time the midsole in the area 26A and 26B tend to distort to allow further cushioning action between the wearing surface and the wearer's foot.

Thus it can be seen that by positioning these cleats at an angle, the resilient action theeof is increased in a manner to facilitate the compression of each cleat and its interaction with the midsole. Since the cleats must be made of a sufficiently hard material to wear satisfactorily, the harder material also tends to compress less. Thus by positioning the cleats at an angle other than normal to the sole bottom planar surface, bending and compression of the cleat is increased to enhance the cushioning effect of the sole as well as the durability.

In accordance with another feature of the invention the cleats are tilted in different directions throughout the sole portion of the shoe in positions to effectively counteract the particular forces generally exerted on the cleats in that area of the shoe. For instance under the heel portion 18 of the shoe, the cleats preferably are positioned to extend at angles extending toward the heel and toe portions. Such is accomplished because acceleration and deceleration actions by the wearer tend to exert forces forward and backward on the shoe in the general direction parallel to a line extending from toe to heel or heel to toe thereof. Thus the cleats tilt parallel to that direction or line and resist distortion sufficiently because of being placed in compression between the sole and the running surface to resist the shear forces and thereby enhance traction with the running surface while increasing the durability of the sole.

In FIG. 4 a force is being exerted on the shoe in the direction of the arrow 30. Such a force can result primarily during acceleration when the heel is being set down to stop. During this period, the cleats 27 in being tilted towards the direction of skid for the shoe, are placed in direct compression to withstand the side forces on the sole. Additionally the lower surfaces 27A tend to remain in parallel contact with the running surface 31. However if the shoe is pressed straight downward as in walking or running at a steady pace, the cleats 27 and 28 will flex and compress to cushion the contact with the surface in the manner previously described.

Similarly, in the forward portions and toe portions of the soles, the cleats are angled or tilted also towards the side of the shoe or in a direction normal to a line joining the toe and heel areas of the shoe. This angular positioning is achieved to counteract side shear forces resulting as the wearer runs around turns which action causes sidewise forces between the shoe and the running surface. In both the toe and heel areas of the sole, the cleats are approximately evenly divided in tilting in opposite directions in the embodiment shown. Thus it can be seen that by the particular angular positioning of these cleats, a greater cushioning effect can be accomplished while enhancing the resisting forces between the shoe and the running surface exerted during particular momentary actions of the wearer in running.

The invention claimed:

1. An athletic shoe for running on a running surface comprising in combination:

a shoe upper portion having heel, shank and toe areas and forming a cavity for receiving the foot;

a sole attached to said shoe upper portion for supporting the foot on a running surface, said sole comprising:

a cushioning pad of resilient material fixed to the upper portion and forming a bottom planar surface for contacting the running surface, said pad having side edges extending from the heel to the toe areas of the shoe upper portion; and a plurality of resilient cleats having a truncated cone configuration fixed to the bottom surface of said cushioning pad and projecting therefrom to contact the running surface, at least a portion of said cleats tilting at an angle other than normal to said planar surface and towards the side edges of the pad thereby to facilitate compression of the cleats to increase the cushioning and stability of the foot during running.

2. An athletic shoe comprising in combination:

a shoe upper portion having heel, shank and toe areas and forming a cavity for receiving a foot;

a sole attached to said shoe upper portion for supporting the foot on a running surface, said sole comprising:

a cushioning pad of resilient material fixed to the upper portion and forming a bottom surface for contacting the running surface, said pad having side edges extending from the heel to the toe areas of the shoe upper portion; and a plurality of resilient cleats having a truncated cone configuration fixed to the bottom surface of said cushioning pad and projecting therefrom to contact the running surface, said cleats adjacent the toe areas being tilted in a direction towards a side edge of the pad to a line extending from the toe to heel areas of the shoe and said cleats in the heel area tilting in a direction towards or away from the toe area of the shoe upper portion.

3. An athletic shoe as defined in claim 2 wherein half the cleats adjacent the heel and toe areas of the shoe tilt in opposite directions from the other half.

* * * * *